United States Patent [19]

Agers

[11] 4,157,605

[45] Jun. 12, 1979

[54] FLUID JET TEXTURING APPARATUS

[75] Inventor: Brian M. Agers, Wilmington, Del.

[73] Assignee: E. I. Du Pont de Nemours and Company, Wilmington, Del.

[21] Appl. No.: 688,248

[22] Filed: May 20, 1976

Related U.S. Application Data

[63] Continuation-in-part of Ser. No. 598,734, Jul. 24, 1975, abandoned.

[51] Int. Cl.[2] ..... D02G 1/16

[52] U.S. Cl. ..... 28/254; 28/273

[58] Field of Search ..... 28/1.4, 254, 273

[56] References Cited

U.S. PATENT DOCUMENTS

| | | | |
|---|---|---|---|
| 3,295,162 | 1/1967 | Forceville | 28/1.4 X |
| 3,485,428 | 12/1969 | Jackson | 28/1.4 UX |
| 3,545,057 | 12/1970 | Lubach | 28/1.4 |
| 3,863,309 | 2/1975 | Price | 28/1.4 |
| 3,881,231 | 5/1975 | Price et al. | 28/1.4 |
| 3,881,232 | 5/1975 | Price et al. | 28/1.4 |
| 3,892,020 | 7/1975 | Koslowski | 28/1.4 X |

*Primary Examiner*—Robert Mackey

[57] ABSTRACT

Increased texturing speed, improved stability of operation and improved operation from jet-to-jet is obtained in a jet of the type disclosed by Lubach in U.S. Pat. No. 3,545,057 by locating the exit end of the orifice through the cylindrical portion of the yarn needle for directing gas to the venturi a distance from 0.375 to 0.65 inch (9.5 to 16.5 mm) from the tip of the needle and locacting a baffle at the outlet end of the jet.

7 Claims, 10 Drawing Figures

FLUID JET TEXTURING APPARATUS

CROSS REFERENCE TO RELATED APPLICATION

This is a continuation-in-part of my copending application, Ser. No. 598,734, filed July 24, 1975, now abandoned.

BACKGROUND OF THE INVENTION

This invention relates to apparatus for air texturing of yarn and, more particularly, to improvements in a fluid jet apparatus used to texture yarn.

It is well known to air jet texture yarn using a jet in combination with a baffle at the outlet end of the jet. A particularly preferred fluid texturing jet is disclosed by Lubach in U.S. Pat. No. 3,545,057. While the jet disclosed by Lubach has been employed with great success to produce textured yarns at substantially higher speeds than were possible with other prior art jet devices, still higher texturing speeds and better product uniformity are desired. Furthermore, certain versions of the jet disclosed by Lubach have been found to be sensitive to small dimensional differences among component parts so that not all jet assemblies work equally well.

SUMMARY OF THE INVENTION

It has now been found that increased texturing speed can be obtained by locating the exit of the orifice for directing gas from the gas inlet to the venturi in a jet of the type disclosed by Lubach in U.S. Pat. No. 3,545,057 a preferred distance of from 0.375 to 0.65 inch (9.5 to 16.5 mm) from the exit end of the yarn guiding element and by locating a baffle adjacent the exit end of the jet.

Prior to the present invention the exit of the orifice for directing gas from the gas inlet to the venturi of these Lubach jets had been located a distance of 0.33 inch (8.4 mm) from the exit end of the yarn guiding element. The "preferred distance" referred to above provides a texturing speed increase, improved stability of operation and improved uniformity of operation from jet-to-jet by itself without sacrificing yarn quality. The use of a baffle without using the "preferred distance" provides a texturing speed increase by itself without sacrificing yarn quality. However, a surprising synergism has been discovered when the combination of the "preferred distance" and a baffle are employed with a jet of the type disclosed by Lubach in that the improvement in speed without sacrificing quality is greater than the sum of the speed increases obtained from using either feature independently.

DETAILED DESCRIPTION OF THE DRAWING

Figure 1:
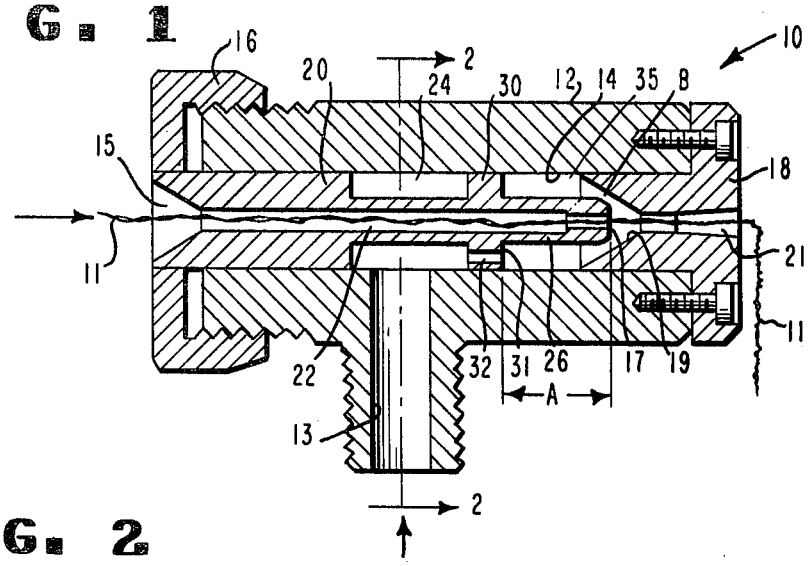
FIG. 1 is an enlarged longitudinal cross-section view of a texturing jet of the invention.
Figure 2:
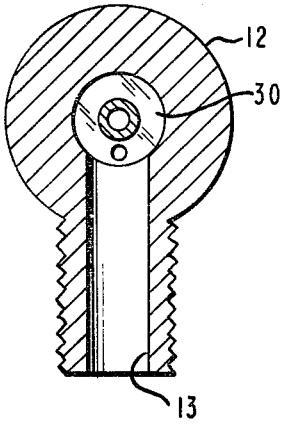
FIG. 2 is a section of FIG. 1, taken along 2—2.

Referring now to the drawing, a yarn texturing jet 10 includes as components, a body member 12 having a central bore 14, a gas inlet 13 leading into the bore 14 intermediate its ends, a cap 16 on the yarn inlet end of the body, a venturi 18 located in the bore 14 at the outlet end of the body, and a yarn guiding element (commonly referred to as a yarn needle in the trade) 20 fixed to the cap 16 sealing off the inlet end of the bore 14 and having a passage 22 therethrough for guiding yarn 11 from the yarn inlet 15 of the jet past the gas inlet 13 through the exit end 17 of the yarn needle to the venturi 18.

The inside of cap 16 and the outside of body 12 are threaded for adjusting the axial position of yarn needle 20 within body 12. The outer diameter of yarn needle 20 is reduced in the region opposite the gas inlet 13 to provide an annular plenum chamber 24, following which is a cylindrical portion 30 with an outer diameter approximately equal to the inside diameter of the bore 14 located beyond gas inlet 13. Cylindrical portion 30 has an orifice 32 through it exiting at surface 31 facing the venturi 18. The forward portion 26 of the yarn needle 20 consists of another portion of reduced diameter which tapers at an included angle of preferably about 60° to exit end 17. Venturi 18 has a converging conical entrance 19 with an included angle of preferably about 60° leading to its exit passage 21 which may be a constant diameter cylindrical bore or preferably may have a short cylindrical portion followed by a conical portion which diverges toward the outlet end of the jet at an included angle of about 7°. The tapering surface on the end of element 20 and the conical entrance 19 of the venturi form an annular restriction between them designated B. Between cylindrical portion 30 and the upstream end of converging conical entrance 19 to venturi 18 is an annular chamber 35.

Typical jets of the type disclosed by Lubach have a diameter of yarn needle exit 17 from about 0.02 to 0.09 inch (0.5 to 2.3 mm), a diameter of the cylindrical portion of the venturi exit passage 21 from about 0.05 to 0.12 inch (1.3 to 3.0 mm), a length of venturi exit passage 21 about 0.40 inch (10.2 mm) comprised of a cylindrical portion having a length of 0.11 inch (3.8 mm) followed by a conical portion of 7 degree included angle, a diameter of orifice 32 from about 0.06 to 0.11 inch (1.5 to 2.8 mm), an outer diameter of forward portion 26 of yarn needle 20 about 0.20 inch (5.1 mm), and an inner diameter of bore 14 about 0.44 inch (11.2 mm).

According to the invention, the improvements as discussed above have been obtained by employing distances from the outlet of orifice 32 to the end of yarn needle 26 (designated A in the drawings) greater than had been known previously, with A being a distance of from 0.375 to 0.65 inch (9.5 to 16.5 mm). It is believed that these improvements stem from the fact that when distance A is within this range, the air stream issuing from orifice 32 is sufficiently diffused to permit an optimum balance between air passing directly through the annular restriction B and air creating turbulence within chamber 35, reducing the criticality of dimensional variations and permitting higher texturing speeds and more stable operation. When dimension A is too small, i.e., less than 0.375 inch (9.5 mm) as in the prior art, a large percentage of the air issuing from orifice 32 goes directly through the restriction B where small variations in the restriction give large variations in the amount of air passing through. Furthermore, only a small portion of the air forms turbulence in chamber 35. On the other hand, when distance A is too great, i.e., greater than 0.65 inch (16.5 mm), the air stream from hole 32 can become too diffuse, fill chamber 35 too uniformly and produce too small a turbulence.

Various factors can affect where an optimum dimension A may be within the preferred range such as, types and deniers of yarns to be textured, the size of orifice 32 and its distance from the axis of yarn needle 20, and the length of orifice 32 with respect to its diameter. The entrance and exit ends of orifice 32 should be manufactured to uniform degrees of sharpness or controlled radius.

The axis of orifice 32 is preferably parallel to the axis of yarn needle 20, degrees of skewness being particularly harmful since they introduce unidirectional swirls which can twist the yarn and prevent the filaments from spreading apart to receive maximum texturing. However, the axis of orifice 32 may intersect the axis of yarn needle 26 if desired.

In operation, yarn 11 enters yarn guiding element 20, travels through passage 22 and leaves the yarn needle at its exit 17. Compressed air enters body 12 through air inlet 13, fills plenum chamber 24 and passes through orifice 32 whence it issues as a compact high-velocity stream into and through annular chamber 35 and impinges on the converging conical entrance 19 of venturi 18. A major portion of the stream then passes immediately through the annular restriction B where it impinges on yarn 11 in an asymmetric manner as the yarn emerges from passage 22 at exit 17. Portions of the air stream, however, are deflected off conical surface 19 and create turbulence within other portions of chamber 35, which turbulent air currents pass through the annular restriction at locations away from the major portion of the stream to enhance the texturing effect. The air then passes out through the venturi 18 along with yarn 11, the yarn being removed from the air stream at approximately 90° to the venturi axis and on the same side of the axis as orifice 32.

It has been found that in general the minimum cross sectional area of annular restriction B is approximately equal to the area of the cylindrical portion of venturi exit passage 21 when the needle is adjusted for optimum yarn quality.

Although a single orifice 32 is preferred, two or more orifices having a total area roughly equivalent to a single orifice may be employed, but such orifice area should be unsymmetrically distributed about the axis of yarn needle 20. The axes of two orifices may be skewed with respect to the axis of yarn needle 20 as long as they are skewed in opposite directions so that net unidirectional swirls are avoided.

The upstream edge of venturi 18 should preferably be sharp when a major portion of air impinges on it so as not to create excessive turbulence, and should be made to uniform manufacturing tolerances.

Although the forward tip of yarn needle 20 adjacent its exit 17 is shown with a flat end surface at 90° to the axis of the yarn passage 21, other end surfaces such as those disclosed by Price in U.S. Pat. No. 3,863,309 work equally well.

Figure 3:
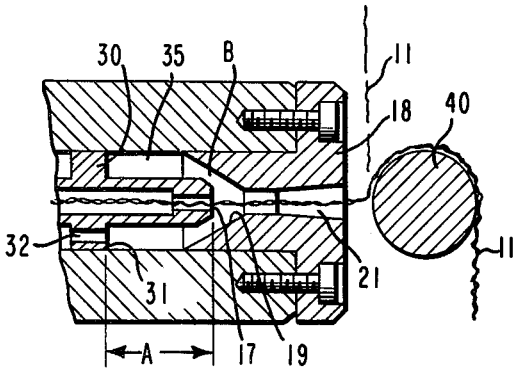
FIG. 3 is an enlarged fragmentary portion of FIG. 1 showing a baffle located adjacent the outlet end of the jet.
Figure 5:
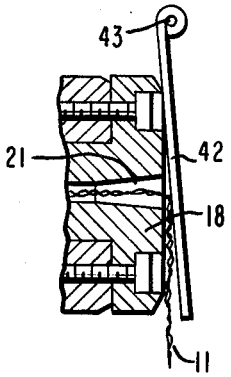
FIG. 5 is an enlarged fragmentary portion of FIG. 1 showing a baffle located adjacent to and freely movable toward and away from the outlet end of the jet.
Figure 9:
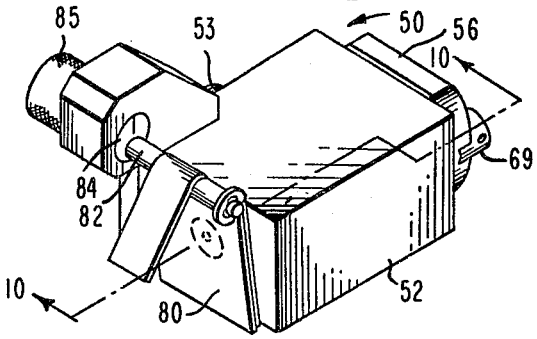
FIG. 9 is a perspective view of a preferred jet embodiment of the invention with a baffle free to seek a force balance position with respect to the outlet end of the jet.

FIG. 3 shows a portion of the jet of FIG. 1 with baffle 40 installed adjacent the venturi exit and approximately centered on the axis of the venturi passage 21. Baffle 40 can be a cylinder with its axis perpendicular to the axis of the venturi passage 21 and approximately perpendicular to the plane of the drawing, or it can be a flat plate as shown in FIG. 9 of Breen U.S. Pat. No. 2,852,906. When such baffle is fixed with relation to the jet, the distance between the end of the jet device and the baffle is preferably 0.05 to 0.15 inch (1.3 to 3.8 mm). The baffle can also be free to seek a force balance position as described by Koslowski in U.S. Pat. No. 3,835,510 especially with light denier yarn such as 150 denier. When a fixed baffle is used, the yarn is preferably removed from the jet exit on the opposite side of the venturi axis from orifice 32. FIG. 5 shows a portion of the jet of FIG. 1 with baffle 42 installed adjacent to and freely movable about hinge point 43 according to the teaching of the above-noted Koslowski patent.

The preferred embodiments shown in FIGS. 6–10 have a similar yarn texturing jet 50 in each embodiment. The jet 50 includes as components a body member 52 having a central bore 54, a gas inlet 53 leading into bore 54 intermediate its ends, a flange 56 located at the yarn inlet end of the body, a venturi 58 located in the bore 54 at the outlet end of the body, and a yarn guiding element 60 commonly referred to as a yarn needle fixed to flange 56 and having a passage 62 therethrough for guiding a yarn 51 from the yarn inlet 55 of the jet past the gas inlet 53 through the exit end 57 of the yarn needle to the venturi 58. The outer diameter of yarn needle 60 which approximates the inside diameter of bore 54 except for the reduced region 63 opposite gas inlet 53 and the reduced forward portion 66 of the yarn needle 60 is smooth and the needle is adapted to slide axially in bore 54. Flange 56 has a counterbored hole 57 through one side which is adapted to freely receive bolt 69. Bolt 69 threads into body 52 and abuts against the counterbore of hole 67 to serve as a stop for the movement of yarn needle 60 out of bore 54, i.e., a means for limiting movement of the flange away from the inlet end of the body 52.

As similarly described in connection with the previous embodiment, a cylindrical portion 70 has an orifice 72 through it exiting at the surface 71 facing the venturi 58. The forward portion 66 of the yarn needle 60 tapers at an included angle of preferably about 60° leading to its exit end 57 which contains a sapphire insert 61 to improve the wear resistance of the exit end of the needle. Venturi 58 has a converging conical entrance 59 leading to its exit passage 63 which as before may be a constant diameter cylindrical bore or preferably may have a short cylindrical portion followed by a conical portion. The tapering surface on the end of the yarn needle 60 and the conical entrance 54 of the venturi 58 form the annular restriction designated as before B. Between the cylindrical portion 70 and the upstream end of converging conical entrance 59 of the venturi is an annular chamber 75.

Figure 6:
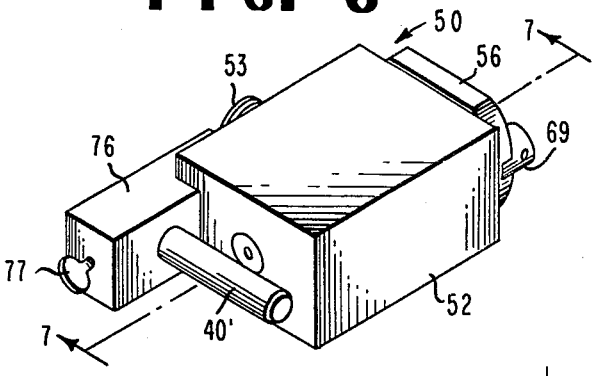
FIG. 6 is a perspective view of a preferred embodiment of the invention with a baffle fixed with relation to the outlet end of the jet.
Figure 7:
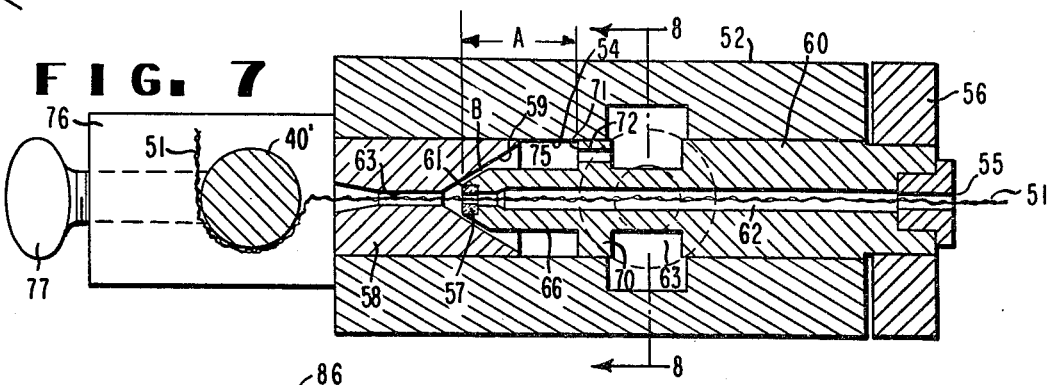
FIG. 7 is an enlarged section of FIG. 6 taken along 7—7.

FIGS. 6 and 7 show the jet 50 with a cylindrical baffle 40' slideably mounted in bracket 76 which is in turn fixed to body 52. The baffle is installed with relation to the exit end of the jet as previously described.

Thumb screw 77 holds baffle 40' in position in bracket 76 and when released the baffle can be slid from the exit of the jet 50 to facilitate access to the exit end for stringup, etc.

Figure 10:
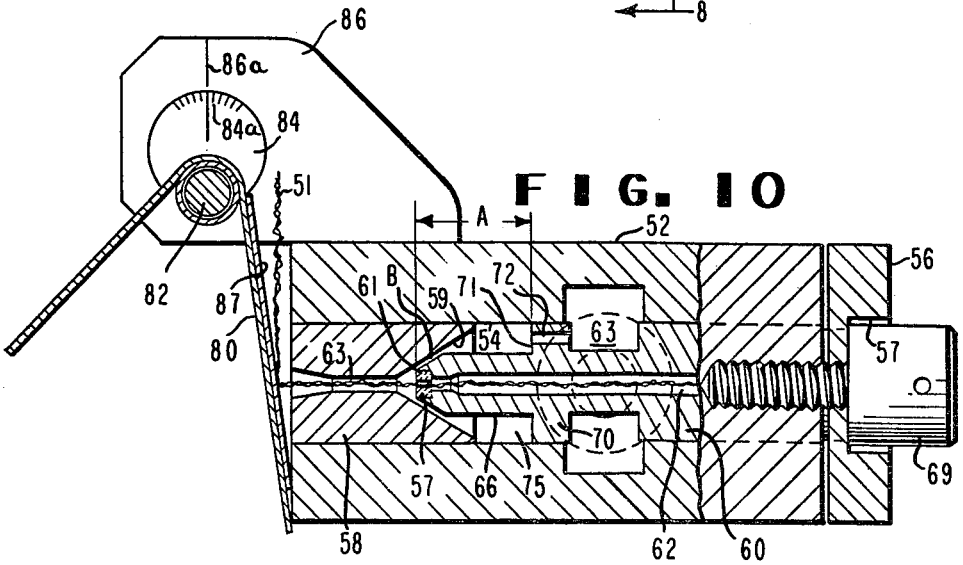
FIG. 10 is an enlarged section of FIG. 9 taken along 10—10.
Figure 8:
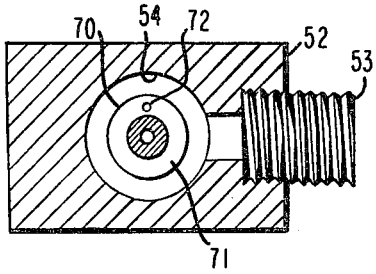
FIG. 8 is a vertical section of FIG. 7 taken along 8—8.

FIGS. 9 and 10 show the jet 50 with baffle 80 movable about hinge pin 82 according to the teaching of Koslowski U.S. Pat. No. 3,835,510. Hinge pin 82 is mounted off-center of cylinder 84 which is rotatable in bracket 86 attached to jet body 52. Knob 85 is used to rotate cylinder 84 to provide an eccentric motion for varying the position of baffle 80 for optimum operating conditions. Index marks 84a on the cylinder 84 and 86a on bracket 86 facilitate setting the baffle to optimum operating position. A layer of wear-resistant ceramic material 87 may be attached to the surface of baffle 80 facing the outlet end of the jet.

As before and for the same reasons discussed above improved operating conditions are obtained by employing distances from the outlet of hole 72 to the end of yarn needle 66 (designated A in the drawings) of from 0.375 to 0.65 inch (9.5 to 16.5 mm).

To stringup the embodiments of FIGS. 6–10, yarn 51 is presented to the inlet 55 end of the jet 50. Compressed air is supplied to the bore 54 through inlet 53. The flange 56 is moved inwardly away from the head of bolt 69, i.e., from the preset operating position to a stringup position so that an aspirating effect draws the yarn 51 through the inlet 55 and out through passage 62. When the yarn emerges from the venturi 58 the flange is allowed to return to its normal preset operating position against bolt 69 under the force of air pressure against yarn needle 60 in reduced region 63. In this manner air pressure in communication with reduced region 63 is relied on to return the yarn needle back to the preset operating position after each stringup.

In the Examples, textured yarn quality was rated on the scale shown in Table I. It should be recognized that commercial limits of acceptable yarn quality can vary considerably depending on the type of fabric, the fabric-making equipment employed, and the price level of the final article. For purposes of defining the present invention, the lower limit of high-quality commercial acceptability is about 3.5.

TABLE I

| Rating | | Yarn Description |
|---|---|---|
| 5.0 | Excellent | - Tight, tension-stable bundle, small loops well distributed along end |
| 4.0 | Good | - Tension-stable bundle, loops well distributed along end, no excessively large loops |
| 3.0 | Fair | - Some loops excessively large, along-end uniformity deteriorating |
| 2.0 | Poor | - Unstable bundle, many loops excessively large |
| 1.0 | Very Poor | - |

The following Examples illustrate the invention using jets of dimensions suitable for a high denier core-and-effect yarn and a low-denier single end yarn. Other combinations of jet dimensions may be optimum for different deniers or types of yarn, and may differ depending on whether the major objective is high yarn speed, high yarn quality or reduced usage of compressed air. With any given apparatus, yarn quality is lower at higher speed, and vice-versa. Low denier yarns and low denier per filament yarns can usually be textured at higher speeds than high denier yarns. Increasing air pressure usually permits operating at higher speed and vice-versa.

EXAMPLE I

A jet device similar to that shown in FIG. 1 having a yarn needle exit 17 of 0.040 inch (1.02 mm) diameter, a diameter of the smallest portion of venturi exit passage 21 of 0.078 inch (0.98 mm) and hole 32 of 0.109 inch (2.78 mm) diameter is supplied with one end of 400 denier 68 filament nylon 66 yarn of trilobal filament cross section at 6.9% overfeed and three ends of the same yarn at 109% overfeed. Compressed air is supplied to inlet 13 at 100–115 psig (7.5–7.8 atm) to produce a textured core-and-effect yarn of 2800 denier. The length of orifice 32 and the thickness of cylindrical portion 30 is 0.12 inch (3.1 mm).

When a prior art device having dimension A of 0.33 inch (8.4 mm) is employed without a baffle, yarn quality of 4.0 is produced at 125 yards/min (114 meters/min), further increase in speed results in rapid drop off in yarn quality. When dimension A is increased to 0.43 inch (10.9 mm) without a baffle, yarn quality of 4.0 is produced at 150 yards/min (137 meters/min). A cylindrical baffle 40 of 0.5 inch (12.7 mm) diameter is then placed 0.1 inch (2.5 mm) from the jet exit as shown in FIG. 3, dimension A being 0.33 inch (8.4 mm). Yarn 11 travels around the top of baffle 40 and downward at the back. A yarn quality of 4.0 is produced at 160 yarns/min (146 meters/min), further increase in speed results in rapid drop off in yarn quality.

Figure 4:
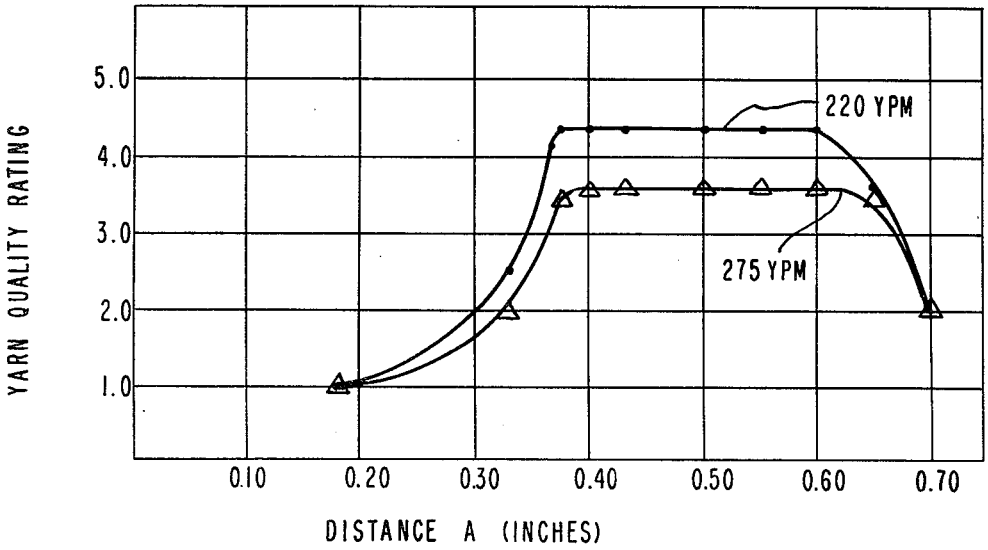
FIG. 4 is a graph showing the relationship of yarn quality to distance A at two different texturing speeds.

Jets with yarn needles having different dimensions A and employing a baffle are then tested at two yarn speeds. Each data point in Table II represents the arithmetic average yarn quality obtained from operating at least 15 jet assemblies. These results are shown in FIG. 4 where circles represent data points at 220 ypm (202 m/min) and triangles represent points at 275 ypm (252 m/min). The criticality of dimension A in the range of 0.375 to 0.65 inch (9.5 to 16.5 mm) in conjunction with a baffle is clearly evident for operation at yarn texturing speeds considerably higher than are obtained with either a baffle or preferred dimension A alone.

TABLE II

| | YARN QUALITY RATING | | | | | | | | | |
|---|---|---|---|---|---|---|---|---|---|---|
| DIMENSION A (inch) | 0.18 | 0.33 | 0.375 | 0.40 | 0.43 | 0.50 | 0.55 | 0.60 | 0.65 | 0.70 |
| 220 ypm | 1.0 | 2.5 | 4.2 | 4.2 | 4.2 | 4.2 | 4.2 | 4.2 | 3.6 | 2.0 |
| 275 ypm | 1.0 | 2.0 | 3.5 | 3.6 | 3.6 | 3.6 | 3.6 | 3.6 | 3.5 | 2.0 |

EXAMPLE II

A jet device similar to that shown in FIG. 1 having a yarn needle exit 17 of 0.020 inch (0.51 mm) diameter, a diameter of the smallest portion of venturi exit 21 of 0.070 inch (1.78 mm) and hole 32 of 0.078 inch (1.98 mm) diameter is supplied with 150 denier 68 filament polyester yarn at 22% overfeed. Compressed air is supplied to the air inlet 25 at 130 psig (8.9 atm). When dimension A is 0.33 inch (8.4 mm), single-end textured yarn of average quality rating 4.0 is taken away at 300 yards per minute (274 meters per min).

When a baffle of Koslowski U.S. Pat. No. 3,835,510 is added to the prior art device, yarn of the same quality is made at 375 ypm (344 m/min). However, when dimension A is changed to 0.43 inch (10.9 m) with the same baffle, yarn of the same quality is made at 600 ypm (550 m/min). In this experiment, the preferred yarn takeaway direction is on the same side of the axis of the yarn needle as hole 32, either with or without the Koslowski baffle.

What I claim is:

1. In a yarn texturing jet including a body having yarn inlet and outlet ends connected by a central bore, means for introducing pressurized gas through a gas inlet into said bore between said ends, a venturi located in said bore at said outlet end, and a yarn guiding element sealing off said bore at the yarn inlet end of the body, said element having a passage therethrough for guiding yarn from the yarn inlet of the body past the gas inlet through the exit end of said element to the venturi, said element having a cylindrical portion thereon approximating the diameter of said bore, said portion extending beyond said gas inlet and terminating in a surface facing and spaced from said venturi, there being an orifice in said portion in communication with said gas inlet and existing at said surface for directing pressurized gas from said gas inlet into said venturi, the improvement comprising: said surface being located a distance of from 0.375 inch to about 0.65 inch from the exit end of said element; and a baffle located adjacent the yarn outlet end of the jet.

2. The jet as defined in claim 1, said baffle having a cylindrical surface, the closest distance from the yarn outlet to said surface being in the range of from 0.05 to 0.15 inch.

3. The jet as defined in claim 1, said baffle being fixed with respect to the yarn outlet at the end of the jet.

4. The jet as defined in claim 1, said baffle being freely movable toward and away from the yarn outlet at the end of the jet.

5. The jet as defined in claim 1, said surface being located a distance of about 0.43 inch from the exit end of said element.

6. The jet as defined in claim 1, said baffle having a cylindrical surface and being fixed with respect to the yarn outlet and the end of the jet, the closest distance from the yarn outlet to said cylindrical baffle surface being in the range of from 0.05 to 0.15 inch.

7. In a yarn texturing jet including a body having yarn inlet and outlet ends connected by a central bore, means for introducing pressurized gas through a gas inlet into said bore between said ends, a venturi located in said bore at said outlet end, and a yarn guiding element sealing off said bore at the yarn inlet end of the body, said element having a passage therethrough for guiding yarn from the yarn inlet of the body past the gas inlet through the exit end of said element to the venturi, said element having a cylindrical portion thereon approximating the diameter of said bore, said portion extending beyond said gas inlet and terminating in a surface facing and spaced from said venturi, there being an orifice in said portion in communication with said gas inlet and exiting at said surface for directing pressurized gas from said gas inlet into said venturi, the improvement comprising: said surface being located a distance of from 0.375 inch to about 0.65 inch from the exit end of said element; and a cylindrical baffle located adjacent the yarn outlet end of the jet, said baffle having a longitudinal axis perpendicular to and approximately intersecting the axis of said venturi, the closest distance from the yarn outlet to the baffle being in the range of from 0.05 to 0.15 inch.

* * * * *